United States Patent [19]

Bahr

[11] 4,054,991

[45] Oct. 25, 1977

[54] ADJUSTABLE HAIR-CLIPPING DEVICES

[76] Inventor: William J. Bahr, 1702 Ohio, Lawrence, Kans. 66044

[21] Appl. No.: 688,308

[22] Filed: May 20, 1976

[51] Int. Cl.[2] ..... B26B 13/24

[52] U.S. Cl. ..... 30/231; 30/233

[58] Field of Search ..... 30/231, 233, 198, 201; 33/186

[56] References Cited

U.S. PATENT DOCUMENTS

| | | | |
|---|---|---|---|
| 851,383 | 4/1907 | Shafer | 30/231 |
| 946,414 | 1/1910 | Wikander | 30/233 X |
| 2,155,241 | 4/1939 | Rubin | 30/231 |

FOREIGN PATENT DOCUMENTS

| | | | |
|---|---|---|---|
| 748,859 | 5/1956 | United Kingdom | 30/233 |

*Primary Examiner*—Jimmy C. Peters
*Attorney, Agent, or Firm*—Sanford S. Wadler

[57] ABSTRACT

An adjustable hair clipping device comprising a base and a support member to which is affixed a cutting member such as a pair of ordinary scissors. The support member includes means for positioning the scissors a predetermined distance from the base.

5 Claims, 1 Drawing Figure

ADJUSTABLE HAIR-CLIPPING DEVICES

BACKGROUND OF THE INVENTION

The present invention relates to an adjustable hair clipping device designed for use by individuals inexperienced in cutting hair and for use by an individual in the cutting of his own hair.

A hair cutter designed to enable inexperienced persons to cut someone else's hair as well as their own is known which consists of a complex mechanism wherein a hair cutter works in combination with a guide assembly having coacting cutter positioning means. For example, in the hair cutter and head mounted guide combination described in Kraus, U.S. Pat. No. 3,272,209 which issued on Sept. 13, 1966, a support frame is adapted to be supported from the head of the person whose hair is being cut. Such support frame requires an arcuate guide member be pivotally secured at one end for rotation about an upstanding axis which passes substantially through the center of the head upon which the support frame rests. A mechanical hair cutter may then be engaged with the arcuate guide member which curves outwardly and downwardly away from the center of the top of the head upon which the support frame rests. By the use of such a device the hair cutter may be moved longitudinally along the guide as such cutter cuts the hair of the person wearing the support frame. In order to facilitate adequate coverage of all of the hair on a person's head a hair cutter supporting carriage is provided which allows for the support of the hair cutter so that such cutter can be moved in a generally radial direction relative to the arcuate path of movement of the carriage relative to the arcuate guide member. To effect radial outward movement of the hair cutter relative to such supporting carriage as the carriage is caused to move along the arcuate guide member from its lower end towards its upper end it is necessary to provide coacting means on the hair cutter and the guide member which is pivotally supported from the support frame. The mechanism which I have described and which is described in more detail in the Kraus patent is not only obviously mechanically complex but also is not readily adaptable for use with ordinary scissors having two opposing blades and looped handles which are pivoted together in the middle and are constructed to cut hair as they slide over each other as the instrument is closed. In addition, the hair cutter and head mounted guide combination of the type described by Kraus must be secured to the head of the person whose hair is being cut after the mechanism is first properly adjusted upon such head. I have also observed that the hair cutter and guide assembly described in the Kraus patent is not designed to be adjusted to cut hair at various predetermined lengths.

It is also known to provide less complex hair cutting guides for use with hair clippers. Such guides are affixed to the clipper so that the clipper may be spaced from the head of the person whose hair is being cut. For example, in the Kaufman patent, U.S. Pat. No. 1,364,559, which issued on Jan 4, 1921, hair cutters are provided with a hinged plate which lifts the clipper as it advances. However, such devices are also not designed to be adjusted to cut hair at various predetermined lengths. Nor are such devices readily adaptable for use with ordinary scissors. In Suozzi, U.S. Pat. No. 3,208, 143, which was issued on Sept. 28, 1965, an adjustable hair cutting guide attachment is provided. However, as is the case regarding the Kaufman patent, the hair cutting guide attachment is not readily adaptable for use with ordinary scissors.

A guide means for cutting long hair to an even length is known which includes a template of semi-rigid material. In this connection see Wall, U.S. Pat. No. 3,935,870 which issued on Feb. 3, 1976. However, devices of the type described in the Wall patent must be draped over the shoulders and back of the person whose hair is being cut. In addition, the template must be held in place by means of a collar portion which is disposed about the neck of a person.

It is an object of the present invention to provide an adjustable hair clipping device which is simple in construction.

It is another object of the present invention to provide an adjustable hair clipping device having a minimum number of mechanical parts.

It is a further object of the present invention to provide an adjustable hair clipping device which does not need to be secured to the head or any other part of the body of the person whose hair is being cut.

Still a further object of the present invention is to provide an adjustable hair clipping device which is readily adaptable for use with ordinary scissors.

Yet a further object of the present invention is to provide a hair clipping device which can be adjusted to cut hair at various predetermined lengths.

SUMMARY OF THE INVENTION

The above and other objects of the present invention can be accomplished by the provision of an adjustable hair clipping device comprising a base, and a support member which includes means for positioning a cutting member a predetermined distance from the base. The cutting member is affixed to the support member at such predetermined position. By means of the present invention the cutting member can be a pair of scissors, if desired, and the support member can be designed to assure that the cutting member maintains such predetermined position. Although not necessary, advantageously the base is designed to conform to the contour of the head of the person whose hair is being cut.

BRIEF DESCRIPTION OF THE DRAWINGS

These and other objects will become apparent from the detailed discussion which follows and from the accompanying drawings, in which.

DESCRIPTION OF THE PREFERRED EMBODIMENTS

Figure 1:
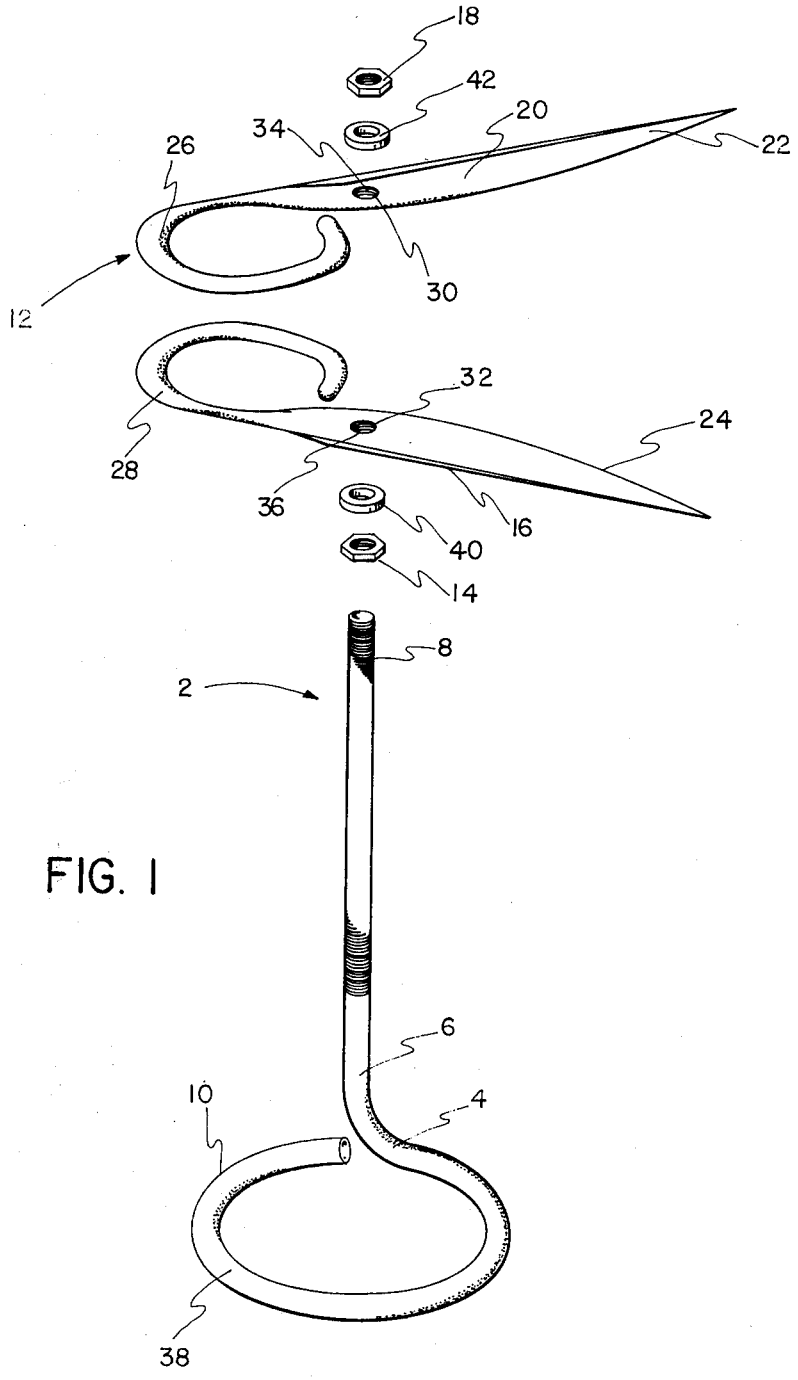
FIG. 1 is an exploded view of one embodiment of the adjustable hair clipping device of the present invention.

The adjustable hair clipping device shown in the drawings comprises a base and a support member, said support member including means for positioning a cutting member a predetermined distance from said base, and a cutting member affixed to said support member at such predetermined position. In one embodiment of the present invention the support member comprises a threaded shaft, and the cutting member is a pair of ordinary scissors having an internally threaded aperture through its opposing blades at the point where the blades are pivoted together. The scissors are screwed upon such threaded shaft through the internally threaded apertures until the scissors are affixed to the support member at a predetermined position relative to the base. In an alternative configuration, a cutting member such as, for example, a pair of scissors is spaced from the base by a first threaded nut, through which the shaft extends, adjacent the portion of the scissors facing towards the base, and a second threaded nut, through which the shaft extends, adjacent the portion of the scissors facing away from the base. The scissors are juxtaposed between the nuts and are affixed at a predetermined position by screwing the first and second nuts upon the shaft until the scissors are positioned at the desired predetermined distance from the base. In a further alternative embodiment other positioning means such as spacing members as described herein may be used to affix the cutting member at the predetermined position on the support member.

Looking now at FIG. 1 there is depicted an adjustable hair clipping device 2 comprising a support member 4 depicted as a shaft 6 having threads 8. The device 2 also comprises a base 10 which is depicted in FIG. 1 as being coextensive with shaft 6. However, it should be noted that base 10 can be a separate unit affixed to the support member 4 and that support member 4 is depicted as a shaft 6 only as a means of illustration, other structures useful as a support member not being excluded. Support member 4 is depicted as including means for positioning cutting member 12 a predetermined distance from the base 10. In the preferred embodiment such positioning means include a first threaded nut 14 adjacent the portion of the cutting member 12 facing towards the base 10 and a second threaded nut 18 adjacent the portion 20 of the cutting member 12 facing away from the base 10. The cutting member 12 is depicted by way of illustration as a pair of ordinary scissors having two opposing blades 22, 24 and looped handles 26, 28 which are pivoted together in the middle about the shaft 4 which extends through apertures 30, 32 which extend through blades 22, 24, respectively. Of course, other types of cutting members may be adapted to be used to form my adjustable hair clipping device if desired.

In operation, after the desired length of hair is determined the first threaded nut 14 is screwed onto the shaft 6 and the shaft 6 is caused to extend through the apertures 30, 32. Then the first threaded nut 14 is screwed upon shaft 6 until the distance between the cutting member 12 and the base 10 is about equal to the predetermined hair length. To assure that the position of the cutting member 12 relative to the base 10 is maintained during operation of the unit a second threaded nut 18 is screwed onto the shaft 6 until it is adjacent the portion 20 of the cutting member 12. Spacing members or washers 40, 42 may be positioned between the nut 14 and the portion 16 of cutting member 12 and between the nut 18 and the portion 20 of the cutting member 12, if desired, to facilitate the pivoting of the blades 22, 24 about shaft 6.

In an alternative embodiment of my invention the apertures 30, 32 which extend through blades 22 and 24, respectively, may include internal threads 34, 36 by means of which the cutting member 12 may be screwed upon the shaft 6 until the cutting member 12 is affixed to shaft 6 at a predetermined position defined by the desired length of hair. In such an embodiment there is no need for first threaded nut 14 and second threaded nut 18 although such nuts may be used to assure that the position of the cutting member relative to the base does not change during operation of the unit.

In the preferred embodiment shaft 6 includes a looped portion 38 which forms the base 10. Such a looped configuration readily conforms to the contour of the head of the person whose hair is being cut. My invention is not limited to such a construction, however, it being understood that other base configurations may be used. Regardless of what form base 10 takes, in operation the base is placed upon the head of the person whose hair is being cut, and while strands of hair are held extended from the scalp in one hand the other hand operates the cutting member to cut such hair. All that is required to cut hair growing from various positions on the head is to move the adjustable hair clipping device so that its base is placed upon the head at such position and to then repeat the cutting operation I have already described. If longer hair is desired all that is required is to adjust the position of the cutting member relative to the base so that the distance between the cutting member and base is increased. If shorter hair is desired all that is required is that the distance between the cutting member and base is similarly decreased.

In another alternative embodiment the positioning means may include at least one spacing member having an aperture through which the shaft 6 extends and adjacent the portion 16 of the cutting member 12 which faces towards the base 10, and a capping unit such as, for example, threaded nut 18 adjacent the portion 20 of the cutting member 12 facing away from the base 10. In such an embodiment the predetermined position of the cutting member relative to the base is determined by the thickness and number of spacing members. For example, in the embodiment depicted in FIG. 1 it is possible to eliminate threaded nut 14 and to space cutting member 12 from base 10 by using a plurality of spacing members 40, the distance between cutting member 12 and base 10 being determined by the thickness and number of spacing members 40.

The adjustable hair clipping device of the present invention is simple in construction and comprises a minimum number of mechanical parts. The device can be readily used without being secured to the head or any other part of the body of the person whose hair is being cut and preferably utilizes ordinary scissors as the cutting member.

The embodiments which have been described herein are but some of several which utilize this invention and are set forth here by way of illustration but not of limitation. It is apparent that many other embodiments which will be readily apparent to those skilled in the art may be made without departing materially from the spirit and scope of this invention.

I claim:

1. An adjustable hair clipping device comprising a curved base and a support member, said support member including means for positioning a cutting member a predetermined distance from said base, and a cutting member affixed to said support member at said predetermined position; and wherein said support member comprises a threaded shaft and said cutting member includes an internally threaded aperture by means of which said cutting member is affixed at said predetermined position; and wherein said cutting member is a pair of scissors and said aperture extends through each of the opposing blades of said scissors at the point where said blades are pivoted together; and wherein one end of said shaft has a looped configuration and forms said base.

2. An adjustable hair clipping device comprising a curved base and a support member, said support member including means for positioning a cutting member a predetermined distance from said base, and a cutting member affixed to said support member at said predetermined position; and wherein said support member comprises a threaded shaft, said cutting member includes an aperture through which said shaft extends, and said positioning means includes a first threaded nut through which said shaft extends and adjacent the portion of said cutting member facing towards said base and a second threaded nut through which said shaft extends and adjacent the portion of said cutting member facing away from said base, said cutting member being affixed at said predetermined position by screwing said first and second nuts upon said shaft until said cutting member is positioned at said predetermined distance from said base; and wherein said cutting member is a pair of scissors and said aperture extends through each of the opposing blades of said scissors at the point where said blades are pivoted together; and wherein one end of said shaft has a looped configuration and forms said base.

3. An adjustable hair clipping device comprising a curved base and a support member, said support member including means for positioning a cutting member a predetermined distance from said base, and a cutting member affixed to said support member at said predetermined position; and wherein said support member comprises a shaft, said cutting member includes an aperture through which said shaft extends, and said positioning means includes at least one spacing member having an aperture through which said shaft extends and adjacent the portion of said cutting member facing towards said base and a capping unit adjacent the portion of said cutting member facing away from said base, said predetermined position being determined by the thickness of said spacing member.

4. The article described in claim 3 wherein said cutting member is a pair of scissors and said aperture extends through each of the opposing blades of said scissors at the point where said blades are pivoted together.

5. The article described in claim 4 wherein one end of said shaft has a looped configuration and forms said base.

* * * * *